United States Patent [19]

Nagahiro et al.

[11] Patent Number: 4,909,196

[45] Date of Patent: Mar. 20, 1990

[54] VALVE OPERATING MECHANISM FOR INTERNAL COMBUSTION ENGINE

[75] Inventors: Kenichi Nagahiro; Tsuneo Konno, both of Saitama; Atsushi Ishida, Kanagawa, all of Japan

[73] Assignee: Honda Giken Kabushiki Kaisha, Tokyo, Japan

[21] Appl. No.: 350,144

[22] Filed: May 10, 1989

[30] Foreign Application Priority Data

May 13, 1988 [JP] Japan ..... 63-116439

[51] Int. Cl.[4] ..... F01L 1/34

[52] U.S. Cl. ..... 123/90.16; 123/90.17; 123/90.6

[58] Field of Search ..... 123/90.15, 90.16, 90.17, 123/90.18, 90.6, 137, 198 F; 74/567

[56] References Cited

U.S. PATENT DOCUMENTS

| | | | |
|---|---|---|---|
| 2,628,605 | 2/1953 | Jones et al. | 123/90.6 |
| 4,535,732 | 8/1985 | Nakano et al. | 123/90.16 |
| 4,537,164 | 8/1985 | Ajiki et al. | 123/90.16 |
| 4,537,165 | 8/1985 | Honda et al. | 123/90.16 |
| 4,545,342 | 10/1985 | Nakano et al. | 123/90.16 |
| 4,576,128 | 3/1986 | Kenichi | 123/90.16 |
| 4,587,936 | 5/1986 | Matsuura et al. | 123/90.46 |
| 4,612,884 | 9/1986 | Ajiki et al. | 123/90.16 |
| 4,656,977 | 4/1987 | Nagahiro et al. | 123/90.16 |
| 4,726,332 | 2/1988 | Nishimura et al. | 123/90.16 |
| 4,727,830 | 3/1988 | Nagahiro et al. | 123/90.16 |
| 4,727,831 | 3/1988 | Nagahiro et al. | 123/90.16 |
| 4,741,297 | 5/1988 | Nagahiro et al. | 123/90.16 |
| 4,788,946 | 12/1988 | Inoue et al. | 123/90.6 |

*Primary Examiner*—Charles J. Myhre
*Assistant Examiner*—Weilun Lo
*Attorney, Agent, or Firm*—Lyon & Lyon

[57] ABSTRACT

A valve operating mechanism for an internal combustion engine wherein a plurality of rotatable cams have different cam profiles for operating an intake or exhaust valve differently in high and low speed ranges of the engine. A plurality of rocker arms are selectively connected or disconnected for transmitting the appropriate cam lift to the valve depending on the engine speed range. The cam profiles have dampening areas at the start of opening and the finish of closing of the valve. The dampening areas of the high speed cam have a smaller rate of change than the dampening areas of the low speed cam to minimize the possibility of engagement by a rocker arm with a cam for one speed while the engine is operating at another speed by another cam and rocker arm.

6 Claims, 4 Drawing Sheets

VALVE OPERATING MECHANISM FOR INTERNAL COMBUSTION ENGINE

The present invention relates to a valve operating mechanism for opening and closing an intake or exhaust port in synchronism with rotation of the crankshaft of an internal combustion engine and, more particularly, to a valve operating mechanism which has a switching device for varying stepwise the timing of the operation of the valve depending on the rotational speed of the crankshaft of the internal combustion engine.

Each of the combustion chambers of a four-cycle internal combustion engine has intake and exhaust valves for drawing an air-fuel mixture into and discharging burned gases from the combustion chamber at prescribed timing. These valves are normally urged to a closed position by valve springs disposed around the respective valve stems of the valves. The valves are forcibly opened against the basic force of the valve springs by cams integrally formed with camshafts which are rotated by the crankshaft of the engine through a belt and pulley mechanism.

Such a valve operating mechanism is subject to thermal deformations depending on the operation of the engine. In order to avoid troubles which would otherwise be caused by thermal expansion, there is provided a gap, called the tappet clearance, between a valve and a cam associated therewith. Noise is produced due to the tappet clearance when the valve is seated but such noise should be as low as possible. To minimize such valve seating noise, the cam profile which determines the rate of change of the cam lift with respect to the angular displacement of the cam includes dampening areas for limiting the speed of movement of the valve in the cam profile portions which start the opening and complete the closing of the valve.

There have been proposed various arrangements in which the timing of operation of a valve is varied depending on the speed of rotation of the engine in order to increase the efficiency with which an air-fuel mixture is charged into the combustion chamber over a wide range o driving conditions.

One conventional device for switching valve operation modes is disclosed in Japanese Laid-Open Patent Publication No. 61-19911, for example. The disclosed switching device has a low-speed cam associated with one intake or exhaust valve and having a cam profile corresponding to a low-speed rotation range of the engine, and a high-speed cam having a cam profile corresponding to a high-speed rotation range of the engine, the cams being integrally formed on a camshaft which is rotatable about its own axis in synchronism with rotation of the engine. The switching device also includes a first rocker arm held in slidable contact with the low-speed cam and engageable with the intake or exhaust valve, a second rocker arm engageable with another intake or exhaust valve, and a third rocker arm held in slidable contact with the high-speed cm. The first through third rocker arms are mounted in mutually adjacent relation on a rocker shaft for relative angular displacement. A selective coupling means is disposed in the first through third rocker arms for switching between a mode in which the first through third rocker arms are coupled to each other for movement in unison and another mode in which the first through third rocker arms are disconnected for relative angular displacement therebetween.

If the dampening areas of the high- and low-speed cams in such a valve operating mechanism have similar gradients, the lift curves of these cams may interfere with each other owing to manufacturing errors. When a plurality of rocker arms that are coupled to each other are operated by the high-speed cam, these rocker arms may even interfere with the low-speed cam.

In view of the above shortcomings of the conventional valve operating mechanism, it is an object of the present invention to provide an internal combustion engine valve operating mechanism which will not bring about mutual interference between high- and low-speed cams in the regions that extend from base-circle portions into dampening areas thereof.

According to the present invention, the above object can be achieved by a valve operating mechanism having a plurality of rotatable cams with cam profiles corresponding to rotational speed ranges of the engine, a valve disposed in an intake or exhaust port of a combustion chamber and normally closed by spring means and openable by said cams, a plurality of transmitting members associated with the cams for imparting cam lifts of the cams to the valve, and switching means for selectively connecting and disconnecting the transmitting means, wherein the cam profiles include base-circle portions and dampening areas contiguous to the base-circle portions and the rates of change of the cam lifts in the dampening areas with respect to the angular displacement of the cams are different from each other among the cams. With the angles of opening of the valve being properly established by high- and low-speed cams, the dampening areas of these cams can be spaced from each other sufficiently to provide against mutual interference.

A preferred embodiment of the present invention will hereinafter be described in detail with reference to the accompanying drawings, wherein FIG. 1 is a fragmentary plan view of a valve operating mechanism having a valve operation mode switching device according to the present invention;

Figure 1:
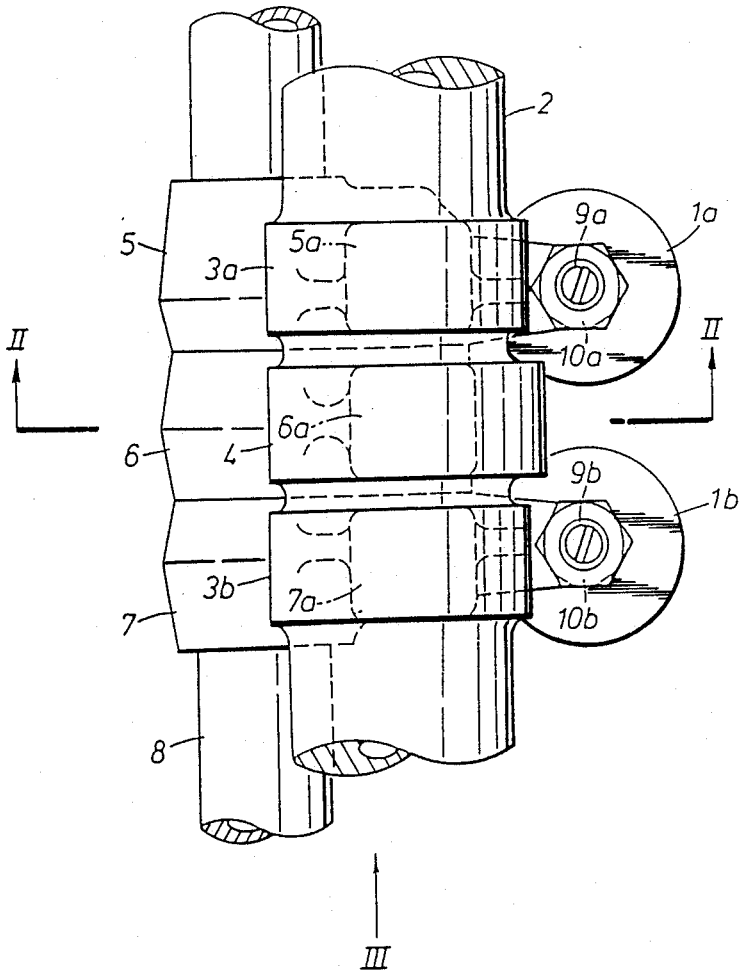

As shown in FIG. 1, a pair f intake valves 1*a*, 1*b* are mounted in the body of an internal combustion engine (not shown). The intake valves 1*a*, 1*b* are opened and closed selectively by a pair of low-speed cams 3*a*, 3*b* or a single high-speed cam 4 which are of a substantially egg-shaped cross section and which cams are integrally formed on a camshaft 2 rotatable by the crankshaft of the engine at a speed ratio of ½ with respect to the speed of rotation of the crankshaft, and by first, second, and third rocker arms 5, 6, 7 engaging the cams 3*a*, 4, 3*b*, respectively, that are angularly movable as valve-lift transmitting members. The internal combustion engine also has a pair of exhaust valves (not shown) which can be opened and closed in the same manner as the intake valves 1*a*, 1*b*.

The first through third rocker arms 5, 6, 7 are pivotally supported in mutually adjacent relation on a rocker shaft 8 extending below and parallel to the camshaft 2. The first and third rocker arms 5, 7 are basically of the same configuration. The first and third rocker arms 5, 7 have proximal ends supported on the rocker shaft 8 and free ends extending above the intake valves 1*a*, 1*b*, respectively. Tappet screws 9*a*, 9*b* are adjustably threaded through the free ends of the first and third rocker arms 5, 7 so as to be engageable with the upper ends of the intake valves 1*a*, 1*b*. The tappet screws 9*a*, 9*b* are prevented from loosening by respective locknuts 10*a*, 10*b*.

Figure 2:
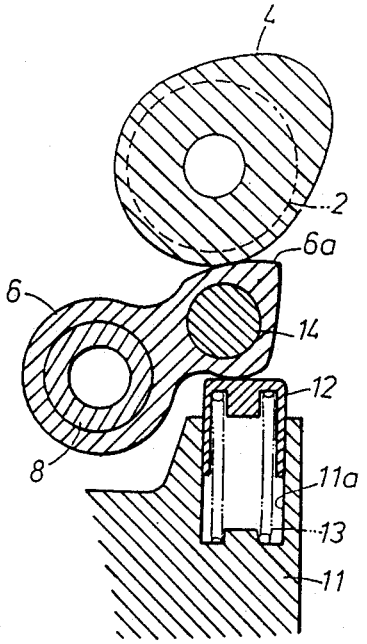
FIG. 2 is a cross-sectional elevation view taken along line II—II of FIG. 1.

The second rocker arm 6 is angularly movably supported on the rocker shaft 8 between the first and third rocker arms 5, 7. The second rocker arm 6 extends from the rocker shaft 8 a short distance toward and intermediate of the intake valves 1*a*, 1*b*. As better shown in FIG. 2, the second rocker arm 6 has on its upper surface a cam slipper 6*a* held in slidable contact with the high-speed cam 4, and also has its lower surface held in abutment against the upper end of a lifter 12 slidably fitted in a guide hole 11*a* defined in a cylinder head 11. The lifter 12 is normally urged upwardly by a coil spring 13 interposed between the inner end of the lifter 12 and the bottom of the guide hole 11*a* to hold the cam slipper 6*a* of the second rocker arm 6 slidably against the high-speed cam 4 at all times.

Figure 3:
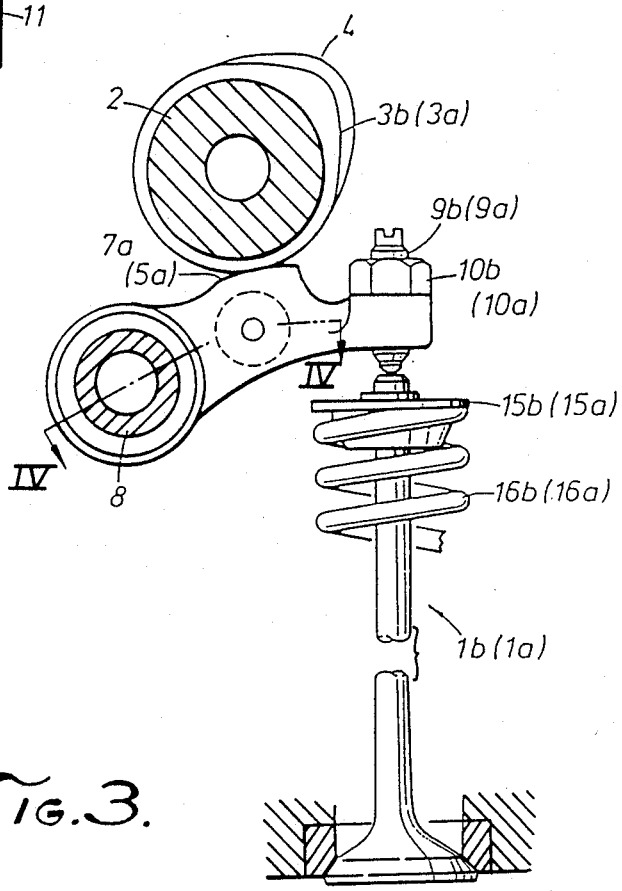
FIG. 3 is an elevation view of the valve operating mechanism as viewed in the direction of the arrow III in FIG. 1.

As described above, the camshaft 2 is rotatably supported above the engine body, and has integrally thereon the low-speed cams 3*a*, 3*b* aligned respectively with the first and third rocker arms 5, 7 and the high-speed cam 4 aligned with the second rocker arm 6. As shown in FIG. 3, the low-speed cams 3*a*, 3*b* each have a cam profile with a relatively small lift and a shape optimum for low-speed operation of the engine. The outer peripheral surfaces of the low-speed cams 3*a*, 3*b* are held in slidable contact with cam slippers 5*a*, 7*a* on the upper surfaces of the first and third rocker arms 5, 7, respectively. The high-speed cam 4 has a cam profile with a higher lift and a wider angular extent of a shape optimum for high-speed operation of the engine. The outer peripheral surface of the high-speed cam 4 is held in slidable contact with the cam slipper 6*a* of the second rocker arm 6. The lifter 12 is omitted from illustration in FIG. 3 for clarity.

Retainers 15*a*, 15*b* are mounted on the upper ends of the valve stems of the intake valves 1*a*, 1*b*, respectively. valve springs 16*a*, 16*b* are disposed around the valve stems of the intake valves 1*a*, 1*b* between the retainers 15*a*, 15*b* and the engine body for normally urging the valves 1*a*, 1*b* upwardly (as viewed in FIG. 3) in a direction to close these valves.

The first through third rocker arms 5, 6, 7 can be selectively switched between a mode in which they are pivotable in unison add another mode in which they are relatively displaceable, by a selective coupling mechanism 14 mounted in holes defined centrally through the rocker arms 5 through 7 parallel to the rocker shaft 8.

Figure 4:
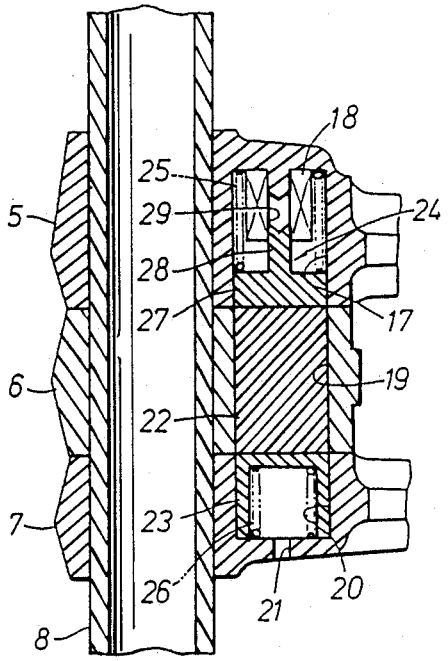
FIG. 4 is a cross-sectional plan view taken along line IV—IV of FIG. 3, showing a low-speed mode of operation.
Figure 5:
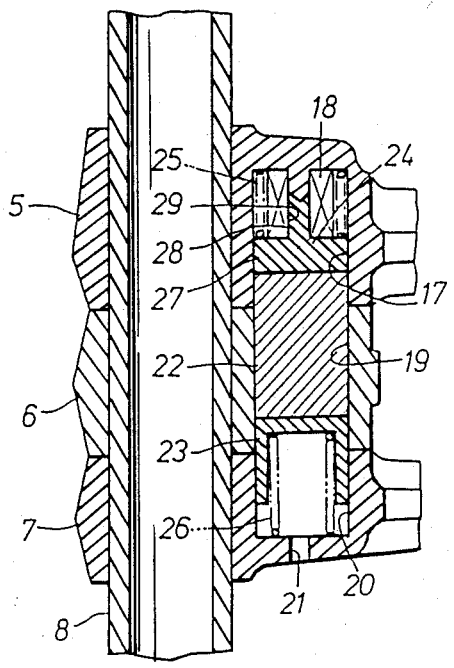
FIG. 5 is a view similar to FIG. 4, showing a high-speed operation mode.

The selective coupling mechanism 14 is illustrated in FIGS. 4 and 5 and will now be described. A first guide hole 17 is defined in first rocker arm 5 parallel to the rocker shaft 8 and opening toward the second rocker arm 6. An air core coil 18 is disposed coaxially in the first guide hole 17 at the bottom thereof. The second rocker arm 6 has a second guide hole 19 defined therethrough between the opposite sides thereof in alignment with the first guide hole 17 in the first rocker arm 5. The third rocker arm 7 has a third guide hole 20 in alignment with the second guide hole 19. The second rocker arm 7 also has a smaller-diameter through hole 21 defined in the bottom of the third guide hole 20 coaxially therewith.

The first, second, and third guide holes 17, 19, 20 house therein a first piston 22 movable between a position in which it connects the first and second rocker arms 5, 6 (FIG. 5) and a position in which it disconnects the first and second arms 5, 6 (FIG. 6), a second piston 23 movable between a position in which it connects the second and third rocker arms 6, 7 and a position in which it disconnects the second and third rocker arms 6, 7, a stopper 24 or limiting the distance over which the pistons 22, 23 are movable in the upward direction, a first coil spring 25 for normally urging the pistons 22, 23 in a direction to disconnect the rocker arms 5, 6, 7, and a second coil spring 26 having a spring constant smaller than that of the first coil spring 25 for normally urging the pistons 22, 23 in a direction to connect the rocker arms 5, 6, 7.

The first piston 22 has an axial dimension which is substantially equal to the entire length of the second guide hole 19, and a diameter that can be slidably fitted into the first and second guide holes 17, 19.

The second piston 23 is sized to slidably fit in the second and third guide holes 19, 20. The second piston 23 has an axial dimension such that when one end of the second piston 23 abuts against the bottom of the third guide hole 20, the other end of the second piston 23 is aligned with and does not project beyond the side of the third rocker arm 7 which faces the second rocker arm 6. The second piston 23 is in the form of a bottomed cylinder with the second coil spring 26 disposed under compression between the inner end of the second piston 23 and the bottom of the third guide hole 20.

The stopper 24 has on one end thereof a disc 27 slidably fitted in the first guide hole 17 and on the other end thereof a guide rod 29 extending into an air core or hole 28 in the coil 18. The first coil spring 25 is disposed under compression around the coil 18 between the disc 27 of the stopper 24 and the bottom of the first guide hole 17.

Operation of the valve operation mode switching device including the selective coupling mechanism 14 will be described below with reference to FIGS. 4 and 5.

While the engine is operating in low- and medium-speed ranges, the coil 18 remains de-energized. Since the spring constant of the first coil spring 25 is higher than that of the second coil spring 26, the pistons 22, 23 are positioned within the guide holes 19, 20, respectively, under the bias force of the first coil spring 25, as shown in FIG. 4. Therefore, the rocker arms 5, 6, 7 are angularly displaceable relatively to each other.

When the rocker arms 5, 6, 7 are disconnected from each other by the selective coupling mechanism 14, the first and third rocker arms 5, 7 are in sliding contact with the low-speed cams 3*a*, 3*b* are pivoted thereby in response to rotation of the camshaft 2. The intake valves 1*a*, 1*b* are opened with delayed timing closed with advanced timing, and opened and closed with across a smaller lift. At this time, the second rocker arm 6 is pivoted by the sliding contact with the high-speed cam 4, but such pivotal movement of the second rocker arm 6 does not affect the operation of the intake valves 1*a*, 1*b* at all.

While the engine is operating in a high-speed range, the coil 18 is energized in timed relation to a detected signal indicating a crank angle or the like. As shown in FIG. 5, the stopper 24 is magnetically attracted to the coil 18 against the bias of the first coil spring 25, whereupon the first and second pistons 22, 23 are moved toward the first rocker arm 5 under the bias force of the second coil spring 26. As a result, the first and second rocker arms 5, 6 are interconnected by the first piston 22, and the second and third rocker arms 6, 7 are interconnected by the second piston 23.

With the first, second, and third rocker arms 5, 6, 7 being thus coupled to each other by the selective coupling mechanism 14 and because the second rocker arm 6 is held in sliding contact with the high-speed cam 4 which pivots to the largest extent, the first and third rocker arms 5, 7 are angularly pivoted with the second rocker arm 6. Therefore, the intake valves 1*a*, 1*b* are opened with advanced timing, closed with delayed timing, and opened and closed with a larger lift, according to the cam profile of the high-speed cam 4.

During the high-speed rotation of the engine, the first and third rocker arms 5, 7 should be not affected by the low-speed cams 3*a*, 3*b*. As described above, the cam profiles include dampening areas in the regions between the base-circle portions and the cam lobe portions which impart lifts to the valves for dampening shocks produced when the valves start being opened and finish being closed. As indicated by cam lift curves H', L' shown in FIG. 6, if dampening areas CH', CL' of the low-speed cams 3*a*, 3*b* and high-speed cam 4 have similar gradients, then these dampening areas CH', CL' may interfere with each other owning to accumulated manufacturing or assembling errors in the various components of the valve operating mechanism. When such mutual interference occurs, the cam slippers 5*a*, 7*a* of the first and third rocker arms 5, 7 tend to contact the dampening areas of the low-speed cams 3*a*, 3*b*, which the cam slippers 5*a*, 7*a* should not contact in the high-speed range, thus producing abnormal noise.

Figure 6:
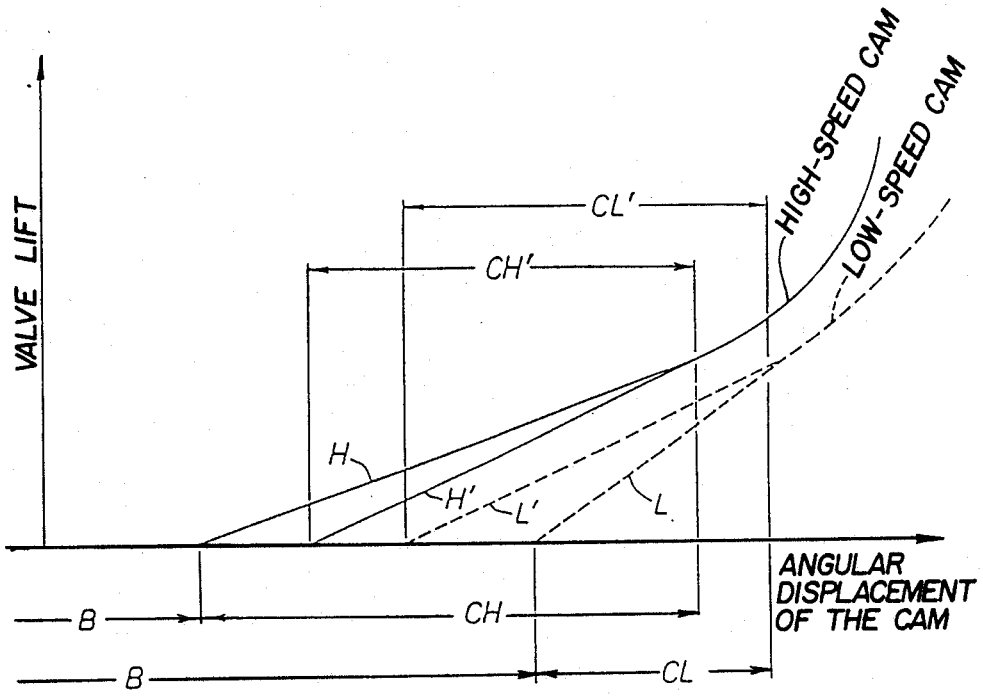
FIG. 6 is a graph showing rates of change of valve lifts with respect to the angular displacement of cams.

According to the present invention, as indicated in zones CH, CL in FIG. 6, the rate H of change of the valve lift in the dampening area of the high-speed cam 4 with respect to the angular displacement thereof is reduced or the rate L of change of the valve lift in the dampening area of each of the low-speed cams 3*a*, 3*b* with respect to the angular displacement thereof is increased or both rates H, L of change may be so modified, i.e. reduced and increased respectively, to increase the separation of these dampening portions of the cam profiles. This modification of the cam profiles eliminates the possibility of mutual interference between the dampening areas of the cams which are provided to smooth the transfer of the cam slippers from the base-circle portions to the cam lobes of the cams. The lines H, H', L, L' in FIG. 6 and the above description are equally applicable to the opening movement and the closing movement of the valves.

The present invention is not limited to the illustrated structure of the selective coupling but rather the principles of the present invention are equally applicable to valve operating mechanisms each having a plurality of cams which have different cam profiles corresponding to respective rotational speed ranges.

With the present invention, as described above, a sufficient gap or interval is provided between the dampening areas of the low- and high-speed cams without affecting the angle of opening of the valves. Since the speed of operation of the valves is high in the high-speed rotation range, the reduced gradient of the dampening areas of the high-speed cam as shown in the above embodiment is highly effective in reducing noise produced when the valves are seated. The increased gradient of the dampening areas of the low-speed cam does not cause a serious trouble because the speed of operation of the valves is low when they are operated by the low-speed cams

We claim:

1. A valve operating mechanism for an internal combustion engine having a plurality of rotatable cams having cam profiles corresponding to rotational speed ranges of the engine, a valve disposed in an intake or exhaust port of a combustion chamber and normally closed by spring means and openable by the cams, a plurality of transmitting members associated respectively with the cams for imparting cam lifts of the cams to the valve, and switching means for selectively connecting and disconnecting the transmitting means, comprising, each cam profile including a base-circle portion and dampening areas contiguous to the base-circle portion, a rate of change of the cam lift in each of said dampening areas with respect to the angular displacement of the cams being different from the cams used for operating in one speed range from the cams used for operating in another speed rang.

2. A valve operating mechanism according to claim 1, wherein the rate of change of the cam lift of the cam which has a cam profile corresponding to a high rotational speed range is smaller than the rate of change of the cam lift of the cam which has a cam profile corresponding to a low rotational speed range.

3. A valve operating mechanism according to claim 1, wherein the cam profile corresponding to a high rotational speed range has a dampening area extending further into the base circle portion than for a conventional cam profile for a high rotational speed range, thereby decreasing the base circle portion and the rate of change of the cam lift of that cam profile corresponding to a high rotational speed range is smaller than for a conventional cam profile for a high rotational speed range.

4. A valve operating mechanism according to claim 1 or 3, wherein the cam profile corresponding to a low rotational speed range has a dampening area extending less into the base circle portion than for a conventional cam profile for a low rotational speed range thereby increasing the base circle portion and the rate of change of the cam lift of that cam profile corresponding to a low rotational speed range is larger than for a conventional cam profile for a low rotational speed range.

5. A valve operating mechanism according to claim 1, wherein the cam profile corresponding to a high rotational speed range has a dampening area for starting the opening of the valve that starts substantially in advance of the dampening area for starting the opening of the valve of the cam profile corresponding to a low rotational speed range.

6. A valve operating mechanism according to claim 1 or 5, wherein the cam profile corresponding to a high rotational speed range has a dampening area for finishing the closing of the valve that ends substantially after the dampening area for finishing the closing of the valve of the cam profile corresponding to a low rotational speed range.

* * * * *